US006742677B2

(12) United States Patent
Petit et al.

(10) Patent No.: US 6,742,677 B2
(45) Date of Patent: Jun. 1, 2004

(54) FLUID DISPENSER PUMP

(75) Inventors: Ludovic Petit, Vitot (FR); Serge Herry, Quatremare (FR)

(73) Assignee: Valois S.A.S., Le Neubourg (FR)

( * ) Notice: Subject to any disclaimer, the term of this patent is extended or adjusted under 35 U.S.C. 154(b) by 0 days.

(21) Appl. No.: 10/414,289

(22) Filed: Apr. 16, 2003

(65) Prior Publication Data

US 2003/0197029 A1 Oct. 23, 2003

Related U.S. Application Data

(60) Provisional application No. 60/382,049, filed on May 22, 2002.

(30) Foreign Application Priority Data

Apr. 18, 2002 (FR) ..... 02 05252

(51) Int. Cl.[7] ..... B65D 88/54

(52) U.S. Cl. ..... 222/321.7; 222/464.3; 222/382

(58) Field of Search ..... 222/464.3, 464.1, 222/321.7, 321.9, 321.2, 321.3, 385, 380, 382, 383.1; 239/333

(56) References Cited

U.S. PATENT DOCUMENTS 2,920,798 A * 1/1960 Samuel ..... 222/402.19
3,120,907 A * 2/1964 Harnage ..... 222/321.9
4,821,923 A * 4/1989 Skorka ..... 222/80
5,062,549 A * 11/1991 Smith et al. ..... 222/377
5,257,739 A * 11/1993 Pascaru ..... 239/266
5,522,548 A * 6/1996 Gallien et al. ..... 239/337
5,560,520 A * 10/1996 Grogen ..... 222/321.2
5,954,239 A * 9/1999 Evans et al. ..... 222/464.4
6,027,041 A * 2/2000 Evans ..... 239/334
6,202,943 B1 3/2001 Evans et al.
6,264,073 B1 * 7/2001 Good et al. ..... 222/464.4

FOREIGN PATENT DOCUMENTS

EP 0 361 079 A1 4/1990
JP 63317484 A * 12/1988 ..... B65D/85/00
JP 9-103717 4/1997
LU 88 593 A 9/1995

* cited by examiner

*Primary Examiner*—Gene Mancene
*Assistant Examiner*—Frederick C. Nicolas
(74) *Attorney, Agent, or Firm*—Sughrue Mion, PLLC

(57) ABSTRACT

A manually-actuated fluid dispenser pump with a pump body (10) having a longitudinal axis (A), and a dip tube (90) connected to the pump body (10) and serving to extend towards the bottom of a reservoir to which the pump is assembled, the pump being characterized in that the dip tube (90) is substantially rigid and extends axially along the longitudinal axis (A) of the pump prior to the pump being assembled to the reservoir, the dip tube (90) being provided with deflection or tilting mechanism (95) so that, after assembly, the dip tube (90) forms an angle with the longitudinal axis (A) of the pump.

11 Claims, 2 Drawing Sheets

FLUID DISPENSER PUMP

CROSS REFERENCE TO RELATED APPLICATION

This application claims the benefit under 35 U.S.C. §119 (e) of U.S. provisional patent application Serial No. 60/382,049, filed May 22, 2002, now abandoned, and priority under 35 U.S.C. §119(a)–(d) of French patent application No. FR-02.05252, filed Apr. 18, 2002.

TECHNICAL FIELD

The present invention relates to a manually-actuated fluid dispenser pump, and to a fluid dispenser including such a pump.

BACKGROUND OF THE INVENTION

To dispense metered doses of fluid contained in a reservoir, it is known that it is possible to use a fluid dispenser pump which is assembled to said reservoir, and by means of which the contents of said reservoir are dispensed by dispensing a dose each time the pump is actuated. To ensure that most of the fluid contained in the reservoir is dispensed, provision is generally made, at least in devices that are used in the upright position, for a dip tube to extend down to the bottom of the reservoir. In order make sure that emptying is good when little fluid remains, provision is often made to dispose the bottom end of the dip tube at a side edge of the bottom of the reservoir, so that, by tilting said reservoir slightly, almost all of the fluid can be dispensed through the dip tube. To achieve that, one of two options is generally chosen. In a first option, the dip tube is flexible and slightly longer in the axial direction than the depth of the reservoir, so that, when the pump is assembled to the reservoir, the bottom end of the dip tube comes into abutment against said bottom of the reservoir, and, by means of its flexibility, is flexed or deflected towards a side bottom edge of said reservoir. However, that is not always possible, in particular when the dip tube is made integrally with a portion extending inside the pump body, which makes it impossible for the dip tube to be made of a flexible material. In addition, the use of flexible dip tubes can be a drawback in certain assembly systems, in particular when the diameter of the opening of the reservoir is very small and when the assembly rate is fast. That can result in the dip tube not penetrating into the reservoir during said assembly. Another option for placing the bottom end of the dip tube at a side bottom edge of the reservoir consists in assembling a dip tube to the pump directly in a tilted configuration, and then in assembling said pump together with said tilted dip tube to the reservoir. That option suffers from a major drawback: it complicates the operation of assembly to the reservoir, since said assembly can no longer be performed merely axially because of the tilt of the dip tube.

BRIEF SUMMARY OF THE INVENTION

An object of the present invention is to provide a fluid dispenser pump that does not suffer from the above-mentioned drawbacks.

In particular, an object of the present invention is to provide a fluid dispenser pump that guarantees good emptying of the contents of the reservoir to which the pump is assembled, in spite of a substantially rigid dip tube being used.

An object of the present invention is also to provide such a fluid dispenser pump that is simple and inexpensive to manufacture and to assemble.

In particular, an object of the present invention is to provide such a fluid dispenser pump that avoids any risk of malfunctioning while the pump is being assembled to the reservoir containing the fluid to be dispensed.

The present invention thus provides a manually-actuated fluid dispenser pump comprising a pump body having a longitudinal axis, and a dip tube connected to said pump body and serving to extend towards the bottom of a reservoir to which said pump is assembled, said pump being characterized in that said dip tube is substantially rigid and extends axially along the longitudinal axis of the pump prior to the pump being assembled to the reservoir, said dip tube being provided with deflection or tilting means so that, after assembly, said dip tube forms an angle with said longitudinal axis of the pump.

In a first embodiment of the present invention, said deflection or tilting means comprise a deflection zone formed on the dip tube in the vicinity of the pump body.

Advantageously, said deflection zone is formed by a thin walled portion of said dip tube.

Advantageously, the dip tube is provided with a radial annular flange that co-operates inside the pump body with an annular end wall of the pump body, said dip tube being assembled to said pump body via the inside of the pump body, and said radial flange supporting the spring of the pump.

Advantageously, the dip tube is provided with a hollow axial tube extending from said radial annular flange towards the inside of the pump body.

Advantageously, said dip tube, said radial annular flange and said axial tube are made integrally with one another.

In a second embodiment of the present invention, said deflection or tilting means comprise a tilt ball connected in leaktight manner to a ball-receiving portion of the pump body.

Advantageously, said tilt ball and said ball-receiving portion are both substantially spherical in shape.

Advantageously, said tilt ball of said dip tube is assembled, in particularly snap-fastened, to said ball-receiving portion of the pump body.

Advantageously, on assembling the pump to a reservoir, the end of the dip tube comes into abutment against the bottom of the reservoir, thereby actuating said deflection or tilting means.

The present invention also provides a fluid dispenser device including a pump as defined above.

BRIEF DESCRIPTION OF THE DRAWINGS

Other characteristics and advantages of the present invention will appear more clearly on reading the following detailed description of two embodiments of it, given with reference to the accompanying drawings, which are given by way of non-limiting example, and in which.

DETAILED DESCRIPTION

Figure 1:
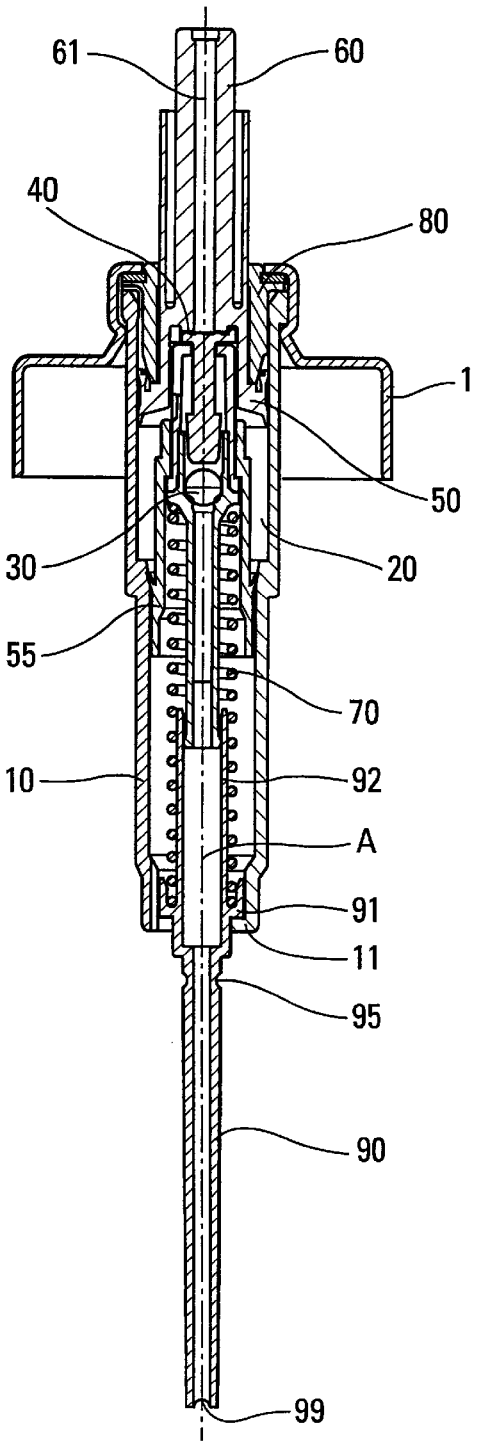
FIG. 1 is a diagrammatic section view of a fluid dispenser pump in a first embodiment of the present invention, prior to said pump being assembled to a reservoir.

The figures show two embodiments of the invention as applied to the same type of pump which is described below.

Naturally, the present invention is applicable to any pump, and the scope of the invention is not limited to the examples shown in the drawings.

With reference to the drawings, the pump includes a pump body 10 having a longitudinal axis A. The pump body 10 is extended by means of a dip tube 90 inside the reservoir 2, only the neck of which is shown diagrammatically in FIGS. 2 and 3. The pump may be assembled to the reservoir by means of a fixing ring 1 which may be of any type, in particular screw-fastenable, crimpable, or snap-fastenable. Generally, a neck gasket 5 is interposed between the fixing ring 1 and the neck of the reservoir 2. The pump shown in the drawings includes a first piston 50 connected (preferably in integral manner) to an actuating rod 60 that is preferably hollow and that incorporates an expulsion channel 61. The user exerts an axial force on said actuating rod 60, e.g. by means of a pusher or by means of a dispensing head (not shown). The pump shown in the drawings further includes a second piston 55 which is mounted to slide in a small-diameter portion of the pump body. A pump chamber 20 is defined between an inlet valve 30 and an outlet valve 40. A return spring 70 is provided in the pump to urge the pump automatically towards its rest position, and to return it to said position after each occasion on which it is actuated. In addition, an abutment element, such as a ferrule 80, is assembled to the top edge of the pump body 10 to define the rest position for the pump.

In the invention, the dip tube 90 is substantially rigid, and it extends along the longitudinal axis A of the pump prior to the pump being assembled to the reservoir. The position prior to assembly is shown in FIGS. 1 and 3. The facts that the dip tube is rigid and that it extends along the longitudinal axis A of the pump facilitate assembly, and remove any risk of malfunctioning in the machine for assembling the pump to the reservoir, in particular when the mouth of the reservoir is small. To ensure that the fluid contained in the reservoir is emptied optimally, it is desirable for the bottom end 99 of the dip tube 90 to be positioned at the bottom side edge of the reservoir after assembly. For this purpose, the substantially rigid dip tube 90 is provided with deflection or tilting means 95 suitable for deflecting or tilting the dip tube 90 once it has been assembled to the reservoir, so that said dip tube 90 forms an angle with said longitudinal axis A, as shown in FIGS. 2 and 4.

Figure 2:
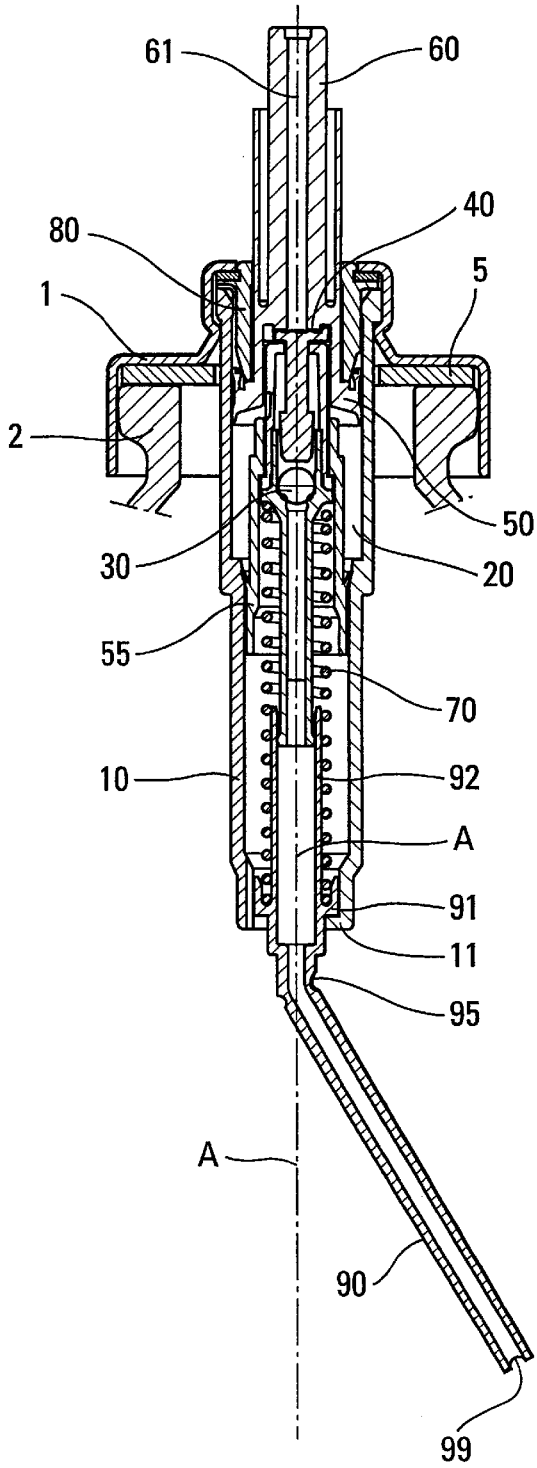
FIG. 2 is a view similar to the view of FIG. 1, after the pump has been assembled to a reservoir.
Figure 3:
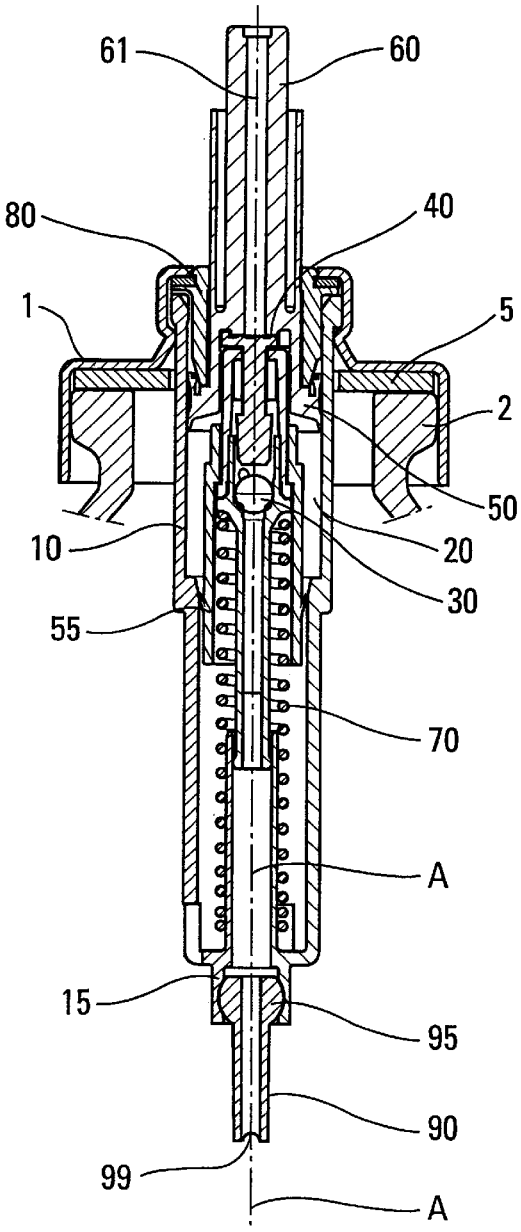
FIG. 3 is a diagrammatic section view of a second embodiment of the present invention, after the pump has been assembled to a reservoir.

FIGS. 1 and 2 show a first embodiment of the invention. In the first embodiment, the deflection or tilting means 95 are in the form of a deflection zone 9. Said deflection zone may advantageously be formed on the dip tube by means of a thin walled portion of said dip tube. Preferably, the deflection zone 95 is disposed in the vicinity of the pump body 10, so that the dip tube 90 is tilted or deflected as close as possible to said pump body 10. In the embodiment shown in FIGS. 1 and 2, the dip tube 90 is formed integrally with a radial annular flange 91 and with a hollow axial tube 92. The radial annular flange 91 co-operates inside the pump body 10 with an annular end wall of the pump body 10. It may support a spring 70 of the pump. The hollow axial tube 92 extends along the longitudinal axis from said radial annular flange 91 towards the inside of the pump body 10, and advantageously serves to be connected to the inlet valve 30 of the pump chamber 20. The fact that the dip tube is made integrally with said radial flange 91 and with said hollow axial tube 92 requires the dip tube to be substantially rigid. Both the radial annular flange 91 and the hollow axial tube 92 must be rigid so that it is not possible for a flexible tube 90 to be made of the same material as them and integrally with them. The first embodiment of the present invention, shown in FIGS. 1 and 2, thus makes it possible to make such a rigid molded dip tube while enabling the reservoir to be emptied optimally by providing said deflection zone 95 which, when the pump is assembled to the reservoir, makes it possible for the dip tube to be deflected so that the bottom end 99 comes into position at a bottom side edge of said reservoir. When the pump is assembled to the reservoir, this is advantageously obtained by the bottom end 99 abutting against the bottom of the reservoir. As with flexible dip tubes, it is necessary merely for the dip tube 90 to be slightly longer than the depth of the reservoir, so that, at the end of assembly, the dip tube comes into abutment against the bottom of the reservoir, thereby actuating the deflection zone 95 and deflecting the dip tube 90 relative to the longitudinal axis A. The molded dip tube shown in FIGS. 1 and 2 is assembled via the inside of the pump body 10, i.e. it is inserted into the pump body via the top edge thereof, and then positioned in abutment against the annular end wall 11 of the pump body, the return spring 70 of the pump then being disposed against said radial annular flange 91 of the dip tube. The dip tube being assembled via the inside of the pump body in this way is also simplified and made more reliable by using a rigid dip tube that extends longitudinally prior to assembly.

Figure 4:
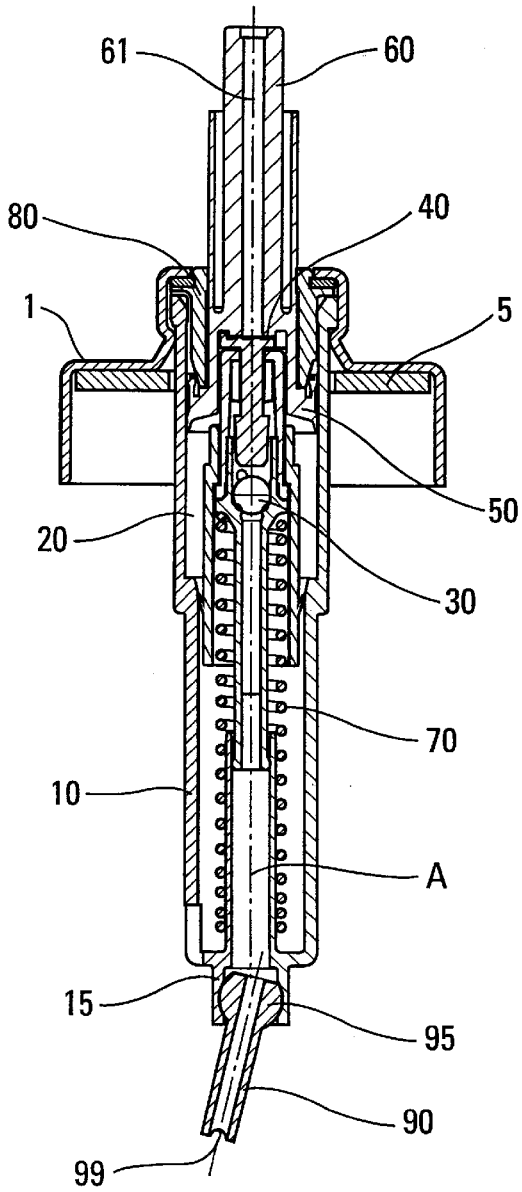
FIG. 4 is a view similar to the view of FIG. 3, after the pump has been assembled to a reservoir.

FIGS. 3 and 4 show a second embodiment of the present invention. The second embodiment differs from the first embodiment in that the dip tube is not assembled via the inside of the pump body 10, but rather it is connected to the pump body via the outside thereof. As shown in FIGS. 3 and 4, the deflection or tilting means 95 for deflecting or tilting the dip tube 90 comprise a tilt ball 95 which is connected in leaktight manner to a ball-receiving portion 15 of the pump body 10. Advantageously, to ensure that the dip tube 90 pivots reliably relative to the longitudinal axis A of the pump, the tilt ball 95 and the ball-receiving portion 15 are both substantially spherical in shape. Advantageously, the ball 95 is snap-fastened inside the ball-receiving portion 15, thereby holding it and sealing the coupling. Similarly to the above-described first embodiment, the dip tube is of length slightly greater than the depth of the reservoir, and, during assembly, the bottom end 99 of the dip tube 90 comes into abutment against the end wall of the reservoir, thereby causing said dip tube 90 to pivot at its tilt ball 95. In the example shown in FIGS. 3 and 4, the length of the dip tube is shown in part only, and it is to be understood that said length may be of any magnitude and must be adapted to the depth of the reservoir, in conventional manner.

The present invention thus makes it possible to provide a fluid dispenser pump provided with a dip tube that is both rigid, thereby making it easier to assemble firstly to the pump body and secondly to the reservoir, and also adapted to be deflected automatically during assembly so as to be positioned against a bottom side edge of the reservoir, thereby facilitating good emptying thereof.

Although the invention is described with reference to two particular embodiments of it, it is to be understood that the person skilled in the art may make any modifications to it without going beyond the ambit of the present invention as defined by the accompanying claims.

What is claimed is:

1. A manually-actuated fluid dispenser pump comprising a pump body (10) having a longitudinal axis (A), and a dip tube (90) connected to said pump body (10) and serving to extend towards the bottom of a reservoir to which said pump is assembled, said dip tube (90) is substantially rigid and extends axially along the longitudinal axis (A) of the pump prior to the pump being assembled to the reservoir, said dip tube (90) provided with deflection or tilting means (95) so that, after assembly, said dip tube (90) forms an angle with said longitudinal axis (A) of the pump; and wherein said dip tube (90) is provided with a radial annular flange (91) that co-operates inside the pump body (10) with an annular end wall (11) of the pump body (10), said dip tube (90) being assembled to said pump body (10) via the inside of the pump body (10), and said radial flange (91) supporting the spring (70) of the pump.

2. A pump according to claim 1, in which said deflection or tilting means (95) comprise a deflection zone (95) formed on the dip tube (90) in the vicinity of the pump body (10).

3. A pump according to claim 2, in which said deflection zone (95) is formed by a thin walled portion of said dip tube (90).

4. A pump according to claim 1, in which the dip tube (90) is provided with a hollow axial tube (92) extending from said radial annular flange (91) towards the inside of the pump body (10).

5. A pump according to claim 4, in which said dip tube (90), said radial annular flange (91) and said axial tube (92) are made integrally with one another.

6. A pump according to claim 1, in which said deflection or tilting means (95) comprise a tilt ball (95) connected in leaktight manner to a ball-receiving portion (15) of the pump body (10).

7. A pump according to claim 6, in which said tilt ball (95) and said ball-receiving portion (15) are both substantially spherical in shape.

8. A pump according to claim 6, in which said tilt ball (95) of said dip tube (90) is assembled, in particularly snap-fastened, to said ball-receiving portion (15) of the pump body (10).

9. A pump according to claim 1, in which, on assembling the pump to a reservoir, the end (99) of the dip tube (90) comes into abutment against the bottom of the reservoir, thereby actuating said deflection or tilting means (95).

10. A fluid dispenser device, characterized in that it includes a pump according to claim 1.

11. A fluid dispenser, comprising:

a reservoir; and a fluid dispenser pump, comprising:

a pump body assembled to the reservoir, the pump body defining a longitudinal axis and having an annular end wall, and a dip tube connected to the pump body and extending towards a bottom of the reservoir, and wherein the dip tube is substantially rigid, the dip tube provided with a deflection portion that is deflected by the insertion of the dip tube into the reservoir, thereby forming an angle with the longitudinal axis of the pump body; and a spring; and wherein the dip tube is provided with a radial annular flange that co-operates inside the pump body with the annular end wall of the pump body, the radial annular flange supporting the spring of the pump.

* * * * *